US006659734B1

(12) United States Patent
Hervault

(10) Patent No.: US 6,659,734 B1
(45) Date of Patent: Dec. 9, 2003

(54) HIGH-PRESSURE PUMP WITH IMPROVED SEALING

(75) Inventor: Christian Hervault, Louvres (FR)

(73) Assignees: Peugeot Citroen Automobiles SA, Neuilly sur Seine (FR); Siemens Automotive SA, Toulouse (FR)

( * ) Notice: Subject to any disclaimer, the term of this patent is extended or adjusted under 35 U.S.C. 154(b) by 77 days.

(21) Appl. No.: 09/937,624

(22) PCT Filed: May 29, 2000

(86) PCT No.: PCT/FR00/01465

§ 371 (c)(1),
(2), (4) Date: Sep. 27, 2001

(87) PCT Pub. No.: WO00/75514

PCT Pub. Date: Dec. 14, 2000

(30) Foreign Application Priority Data

Jun. 8, 1999 (FR) ..... 99 07214

(51) Int. Cl.[7] ..... F04B 1/12
(52) U.S. Cl. ..... 417/269; 417/454; 417/571
(58) Field of Search ..... 417/269, 454, 417/571; 91/499; 92/71

(56) References Cited

U.S. PATENT DOCUMENTS

| | | | | |
|---|---|---|---|---|
| 2,664,048 A | | 12/1953 | Huber | |
| 3,692,052 A | | 9/1972 | Cattanach | |
| 4,594,058 A | * | 6/1986 | Fischell | 417/413.1 |
| 4,792,287 A | | 12/1988 | Alaze et al. | |
| 4,878,815 A | * | 11/1989 | Stachowiak | 417/63 |
| 4,993,925 A | * | 2/1991 | Becker et al. | 417/413.1 |
| 5,241,986 A | * | 9/1993 | Yie | 137/512 |
| 5,601,345 A | * | 2/1997 | Tackett | 303/116.4 |
| 5,707,219 A | * | 1/1998 | Powers | 417/386 |
| 5,899,671 A | * | 5/1999 | Horn | 417/387 |
| 6,095,774 A | * | 8/2000 | Tanaka et al. | 417/540 |
| 6,213,096 B1 | * | 4/2001 | Kato et al. | 123/456 |
| 6,439,859 B1 | * | 8/2002 | de Matthaeis et al. | 417/273 |

FOREIGN PATENT DOCUMENTS

| | | |
|---|---|---|
| CH | 466 045 | 1/1969 |
| FR | 860429 | 1/1941 |
| WO | WO 97/47883 | 12/1997 |

* cited by examiner

*Primary Examiner*—Sang Y. Paik
*Assistant Examiner*—Vinod D. Patel
(74) *Attorney, Agent, or Firm*—Connolly Bove Lodge & Hutz LLP

(57) ABSTRACT

The invention concerns a pump for pumping a first liquid, called transferred liquid, and comprising a main unit (18) for pumping the transferred liquid actuated by an auxiliary unit (20) pumping a second liquid, called working liquid. The main (18) and auxiliary (20) units are housed in a casing (16) generally cylindrical in shape. The main unit (18) comprises at least two valves (36, 38), for respectively sucking up and delivering the transferred liquid, borne by a valve body (40) housed in the casing (16). Each valve (36, 38) communicates with two chambers, respectively a suction chamber (46) and a delivery chamber (48) for the transferred liquid, defined by opposite surfaces (50, 52) provided in the valve body (40) and the casing (16). Said surfaces (50, 52) comprise two matching shoulders (50E, 52E) pressed against each other so as to form a tight joint plane separating the suction chamber (46) and the delivery chamber (48). The invention is applicable to a high pressure pump for supplying a motor vehicle engine with fuel.

5 Claims, 10 Drawing Sheets

HIGH-PRESSURE PUMP WITH IMPROVED SEALING

FIELD OF THE INVENTION

The present invention relates to a high-pressure pump with improved sealing.

It applies in particular to a high-pressure pump for supplying a motor vehicle internal combustion engine with fuel. In this case, the transferred liquid is the fuel.

BACKGROUND OF THE INVENTION

The state of the art already discloses a high-pressure pump for pumping a first liquid, known as the transferred liquid, of the type comprising a main unit for pumping the transferred liquid and actuated by a secondary unit for pumping a second liquid, known as the working liquid, and of the type comprising a housing of cylindrical overall shape, in which the main and secondary units are arranged, the main unit comprising at least two valves, namely an intake valve and a delivery valve for the transferred liquid, carried by a valve body housed in the housing, each valve communicating with two chambers, namely an intake chamber and a delivery chamber for the transferred liquid, delimited by opposing surfaces of cylindrical overall shape, of axis coinciding more or less with that of the housing, formed in the valve body and in the housing.

BRIEF DESCRIPTION OF THE INVENTION

A pump of this type is described, for example, in WO 97/47883.

In the pump described in that document, the intake and delivery chambers connected to the valves are separated by a rubber O-ring seal. This seal, housed in an annular groove formed in a peripheral surface of the valve body, is relatively bulky.

A particular object of the invention is to propose a high-pressure pump, of the aforementioned type, equipped with means which are effective and not very bulky for separating the intake and delivery chambers.

To this end, the subject of the invention is a high-pressure pump of the aforementioned type, characterized in that the opposing surfaces comprise two complementary shoulders bearing on one another so as to form a sealed joining plane separating the intake and delivery chambers.

According to other features of the invention:

- the housing comprises a body and a cover forming the respective two opposite ends of this housing, the housing body being connected to the cover by at least one screw more or less parallel to the axis of the housing, having a head bearing on a seat formed in the housing body, and a threaded body screwed into a tapped orifice in the cover, the pump additionally comprising an intermediate assembly clamped axially between a skirt of the housing body, internal to the cover, and the valve body so that the housing body, the intermediate assembly and the valve body are clamped between the head of the screw and the joining plane;
- the intermediate assembly comprises a body in which a piston of the secondary unit is mounted so that it can slide, this piston being intended to compress the working liquid;
- the housing and the valve body are made of a lightweight metal such as aluminum or of an aluminum-based alloy;

- the intermediate assembly is made of steel or cast iron and the screw is made of steel, the axial dimension of the intermediate assembly being more or less equal to the length (L2) of the part of the body of the screw extending between the head of this screw and the tapped orifice of the cover; and
- the transferred liquid is a fuel for a motor vehicle internal combustion engine.

BRIEF DESCRIPTION OF THE DRAWINGS

The invention will be better understood from reading the description which will follow, given solely by way of example and made with reference to the drawings in which:

FIGS. 1 to 3 depict a high-pressure pump according to the invention, denoted by the general reference 12. In the example described, the pump 12 is intended to supply a motor vehicle internal combustion engine with fuel at high pressure. The pump 12 is therefore intended to pump a first liquid, namely fuel in the example described, known as the transferred liquid.

Figure 1:
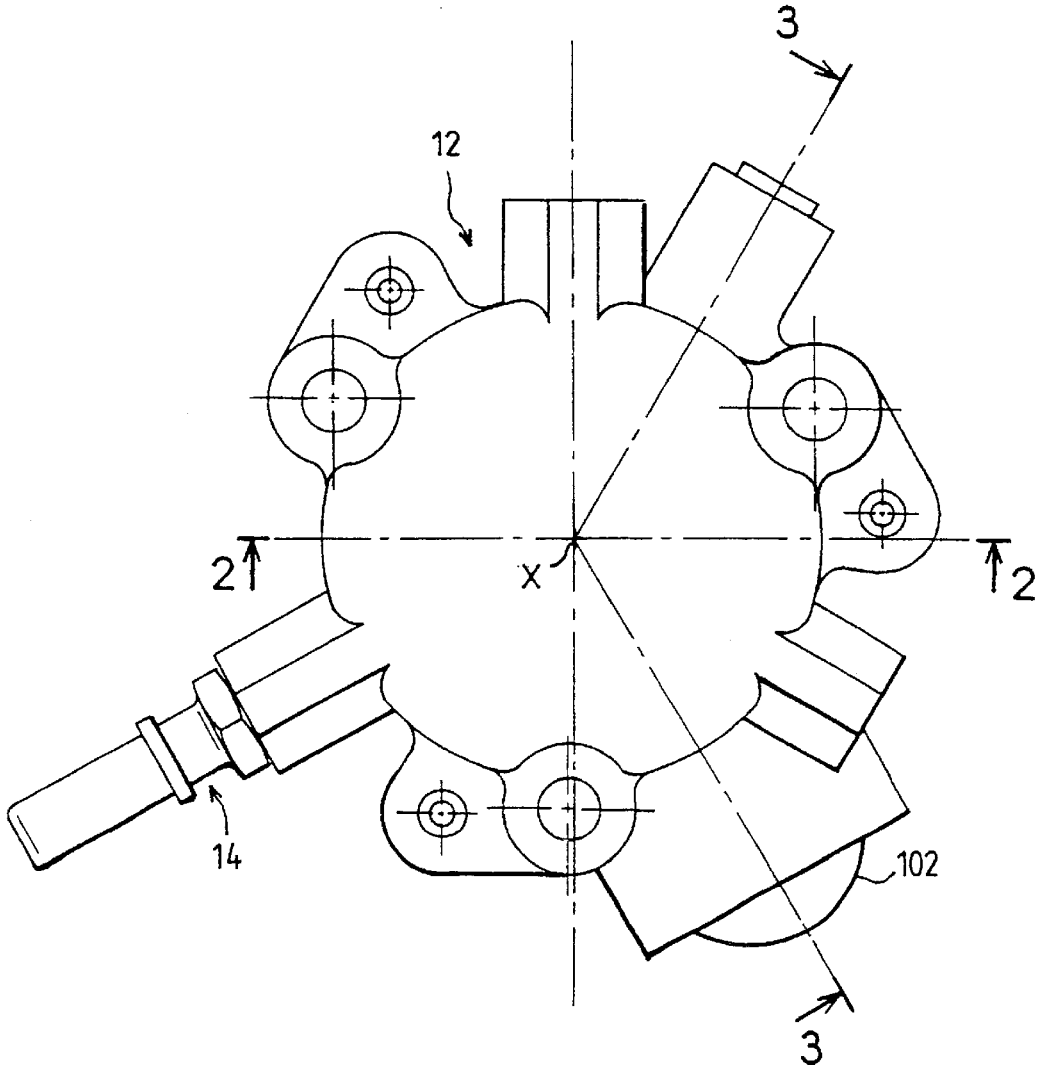
FIG. 1 is a front view of a high-pressure pump according to the invention.

Visible in FIG. 1 is a connection 14 intended to connect the pump 12 to a fuel tank.

Figure 2:
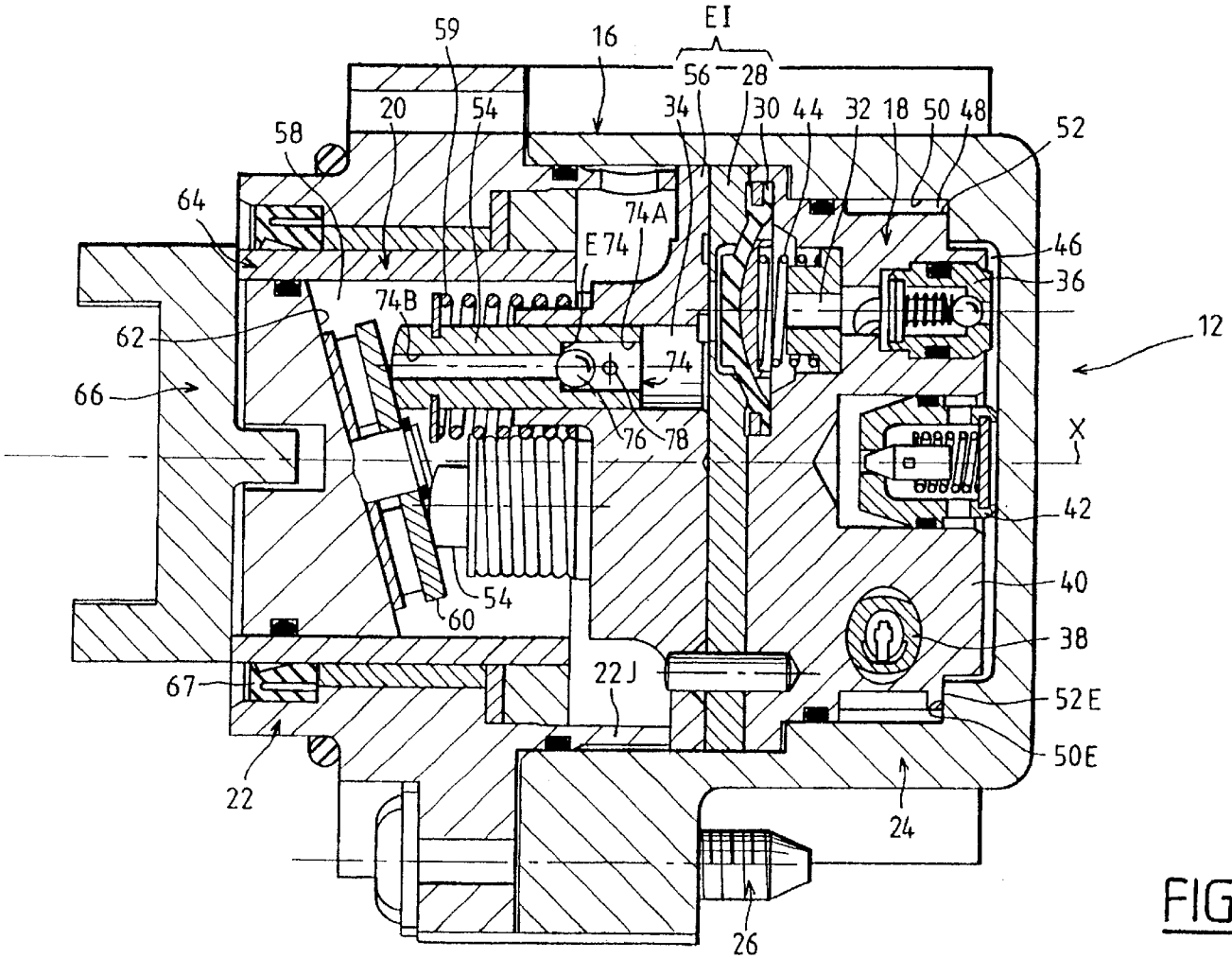
FIG. 2 is a view in section on the line 2—2 of FIG. 1.
Figure 3:
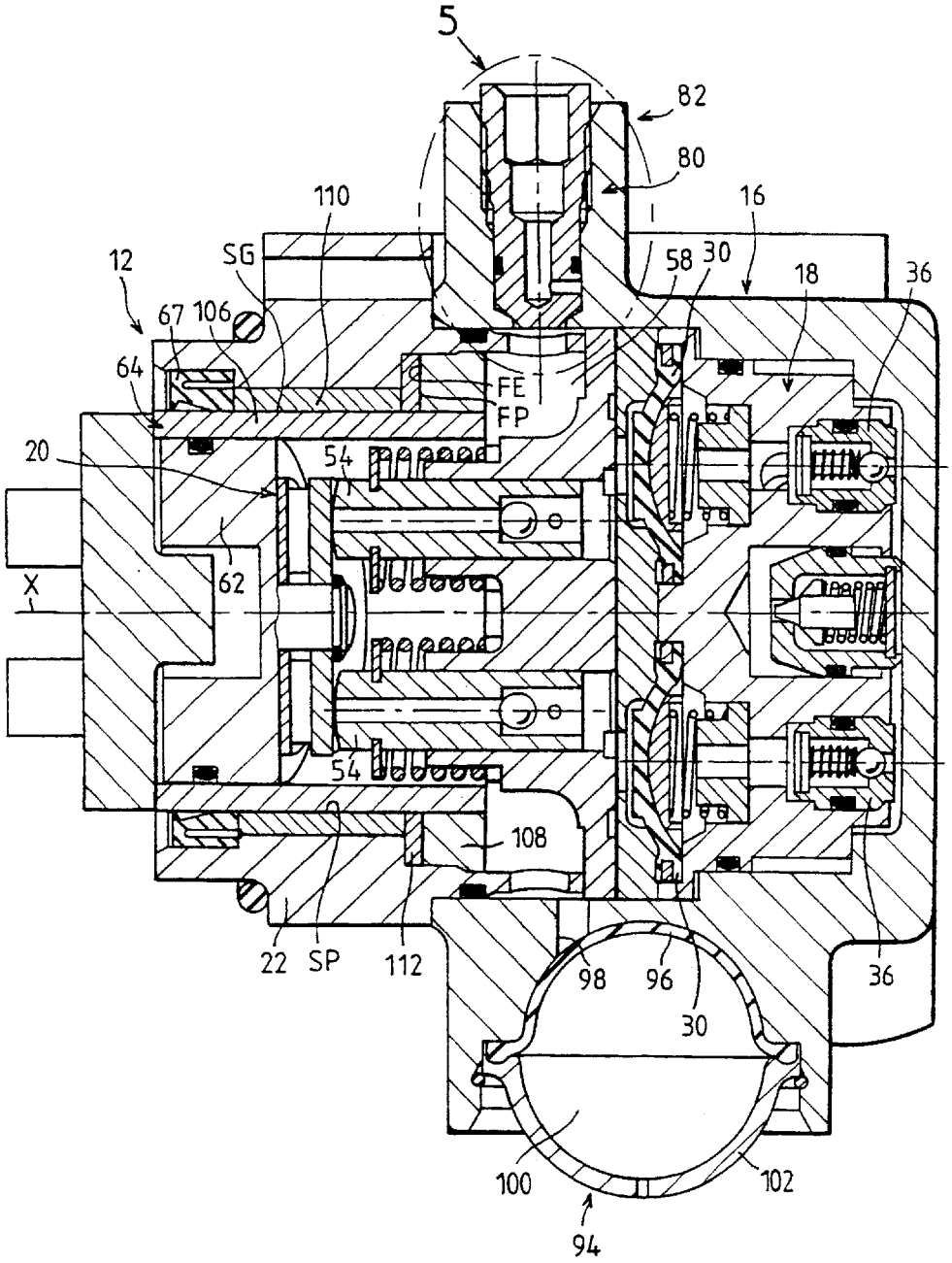
FIG. 3 is a view in section on the line 3—3 of FIG. 1.

With more particular reference to FIGS. 2 and 3, it can be seen that the pump 12 comprises a housing 16 of cylindrical overall shape, of axis X, in which are arranged a main unit 18 for pumping fuel and a secondary unit 20 for pumping a conventional second liquid, for example a mineral oil, known as the working liquid. The main unit 18 is actuated by the secondary unit 20, according to the general conventional operating principles described, for example, in WO 97/47883.

DETAILED DESCRIPTION OF THE INVENTION

The housing 16 comprises a body 22, of cylindrical overall shape, surrounding the secondary unit 20, and a cover 24, of cylindrical overall shape, surrounding the main unit 18. The housing body 22 and the cover 24 respectively form two opposite ends of the housing 16.

The housing body 22 is connected to the cover 24 by at least one screw 26, for example three screws 26. Each screw 26, preferably made of steel, extends more or less parallel to the axis X. A screw 26 will be described in greater detail later.

Inside the housing 16, the main unit 18 is separated from the secondary unit 20 by a separating disk 28 centered more or less on the axis X. This disk 28 is preferably made of steel or cast iron.

The main unit 18 comprises at least one flexible diaphragm 30 for pumping fuel, for example three diaphragms 30, as in the example illustrated. It will be noted that just two diaphragms 30 are depicted in the figures, particularly in FIG. 3.

The diaphragm 30 separates a fuel-pumping chamber 32, arranged in the main unit 18, from a chamber 34 for compressing the working liquid, arranged in the secondary unit 20. The volume of the pumping chamber 32 is variable. The compression chamber 34 is formed partially in the separating disk 28.

Associated with each pumping chamber 32 are a fuel intake valve 36 and a fuel delivery valve 38. These valves 36, 38, of conventional structure and operation, are carried by a body 40 housed in the cover 24 between an end wall thereof and the separating disk 28.

To make the pump 12 lighter, the housing body 22, the cover 24 and the valve body 40 are made of aluminum or aluminum-based alloy, or alternatively from some other equivalent lightweight metal.

The valves 36, 38 are connected in a way known per se to the corresponding pumping chamber 32 and to a safety valve 42 of conventional structure and operation.

In the conventional way, each diaphragm 30 can move between a first position in which the pumping chamber 32 has maximum volume, as depicted in particular in FIGS. 2 and 3, and a second position in which this pumping chamber has minimum volume (this position is not depicted in the figures). The movements of the diaphragm 30 are dictated in particular by the secondary unit 20 and control the opening and closing of the fuel intake and delivery valves 36, 38.

Each diaphragm 30 is constantly elastically returned to its first position by a spring 44 known as the diaphragm spring.

Each valve 36, 38 communicates, on the one hand, with a fuel intake chamber 46 and, on the other hand, with a fuel delivery chamber 48. The intake chamber 46 is connected, in a way known per se, to the fuel supply connection 14.

The fuel intake 46 and delivery 48 chambers are delimited, at least in part, by opposing surfaces 50, 52, of cylindrical overall shape, of an axis coinciding more or less with the axis X. A first surface 50 forms an internal surface of the cover 24. The second surface 52 forms a peripheral surface of the valve body 40.

The opposing surfaces 50, 52 comprise two complementing shoulders 50E, 52E bearing against one another so as to form a sealed joining plane separating the intake 46 and delivery 48 chambers. This joining plane is more or less perpendicular to the axis X. The shoulders 50E, 52E form an effective metal-to-metal seal.

It will be noted that the intake chamber 46, in which the pressure is lower than it is in the delivery chamber 48, is delimited by the end wall of the cover 24, the thickness of which is relatively small. By contrast, the delivery chamber 48 is delimited by a peripheral wall of the cover 24 which is thicker than the end wall of this cover, so as to withstand the high pressure reached by the fuel flowing through this delivery chamber.

The secondary unit 20 comprises a piston 54 for compressing the working liquid, this piston being associated with each diaphragm 30 and intended to move this diaphragm 30 between its two positions. Thus, in the example described, the secondary unit 20 has three pistons 54, just two of which are visible in the figures, particularly in FIG. 3.

The piston 54 is mounted so that it can slide in a body 56, preferably made of steel or cast iron, so that it can be moved more or less parallel to the axis X. The piston 54 extends between the chamber 34 for compressing the working liquid, formed partly in the piston body 56, and a reservoir 58 of working liquid.

The end of the piston 54 external to the piston body 56 is returned elastically by a spring 59 into contact with a thrust rolling bearing, for example a thrust needle bearing 60, borne by a swashplate 62 that operates the pistons 54. This swashplate is carried via a hub 64 of the secondary unit 20. This hub 64 is mounted so that it can rotate about the axis X in the housing body 22 which forms a bearing mount. The swashplate 62 revolves about the axis X together with the hub 64, the latter being connected to conventional drive means by a coupling 66 of the Oldham type. Sealing against the working liquid between the housing body 22 and the hub 64 is provided by conventional means comprising, in particular, an annular seal 67 made of elastomer. The hub 64 will be described in greater detail later.

Figure 4:
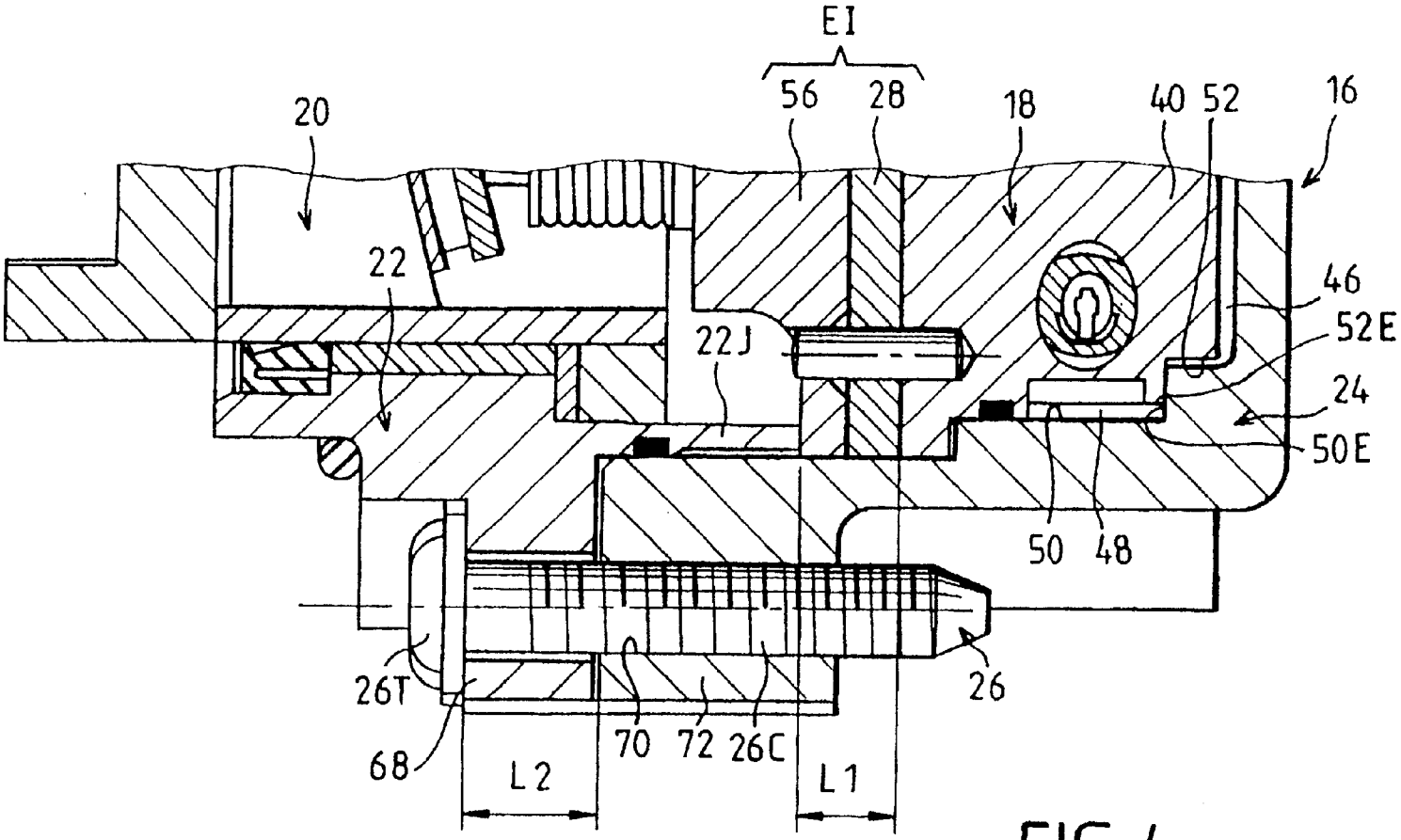
FIG. 4 is a detail view of FIG. 2, in which the section plane has been offset slightly to make it pass through the axis of the screw depicted in these FIGS. 2 and 4.

It will be noted that the separating disk 28 and the piston body 56 form an intermediate assembly EI clamped axially between a skirt 22J of the housing body 22, internal to the cover 24, and the valve body 40. Furthermore, referring in particular to FIG. 4, it can be seen that each screw 26 has a head 26T and a threaded body 26C. The head 26T bears against a seat 68 formed in the housing body 22. The threaded body 26C is screwed into a tapped orifice 70 made in a lug 72 secured to the cover 24. As a result of this, the housing body 22, the intermediate assembly EI and the valve body 40 are clamped between the head 26T of the screw and the joining plane embodied by the shoulders 50E, 52E.

As a preference, the axial dimension Ll of the intermediate assembly EI is more or less equal to the length L2 of the part of the body 26C of the screw that extends between the head 26T of this screw and the tapped orifice 70. Thus, the extensions of the various materials, namely, on the one hand, the aluminum or the lightweight metal and, on the other hand, the steel or cast iron, are more or less the same inside and outside the housing 16.

Referring once again to FIGS. 2 and 3, it can be seen that the piston 54 has an axial bore 74 through which the working liquid can flow between the reservoir 58 and the compression chamber 34. A first end of the bore 74, internal to the piston body 56, communicates permanently with the compression chamber 34. The second end of the bore 74, external to the piston body 56, communicates permanently with the reservoir 58.

As a preference, the bore 74 is stepped and has a large-diameter portion 74A, opening into the compression chamber 34, and a small-diameter portion 74B, opening into the reservoir 58.

A ball, forming a valve 76, is housed in the large-diameter portion 74A so that it can be moved, on the one hand, between a shoulder E74 separating the portions 74A and 74B, forming a seat for closing the valve 76 and, on the other hand, a stop 78 that limits the opening travel of this valve 76.

The valve 76 opens as soon as the pressure of the working liquid in the reservoir 58 exceeds that of the working liquid in the compression chamber 34. If the reverse is true, the valve 76 closes so as to close off the bore 74.

For the pump 12 to work correctly, the stiffness of the return spring 44 for the diaphragm 30 associated with the piston 54 is rated so that this spring 44 keeps the working liquid contained in the compression chamber 34 at a raised pressure compared with the working liquid contained in the reservoir 58, this being as long as the diaphragm 44 has not reached its first position in which the pumping chamber 32 has its maximum volume.

A few particular characteristics of the operation of the main 18 and secondary 20 pumping units will be indicated hereinbelow, the main unit 18 operating according to the principles of a positive-displacement pump.

When the swashplate 62 drives the piston 54 into the piston body 56 (moving the piston 54 to the right when considering FIGS. 2 and 3), the working liquid contained in the compression chamber 34 is compressed (to a raised pressure compared with the liquid contained in the reservoir 58) so that the valve 76 closes and the flexible diaphragm 30 moves toward its second position in which the pumping chamber 32 has its minimum volume. This, in the conventional way, causes fuel to be delivered at high pressure to the delivery chamber 48.

When the swashplate 62 allows the piston 54 to move in the opposite direction to the previous one (to the left when considering FIGS. 2 and 3) under the effect of the return spring 59, the diaphragm 30 is returned by the spring 44 to its first position in which the pumping chamber 32 has maximum volume. This, in the conventional way, causes fuel from the intake chamber 46 to be drawn into the pumping chamber 32.

It will be noted that the diaphragm spring 44 allows the diaphragm 30 to return automatically to its first position, even in the absence of fuel in the main pumping unit 18. Furthermore, when the piston 54 moves to the left when considering FIGS. 2 and 3, given the leaks of working liquid between the compression chamber 34 and the reservoir 58, the diaphragm 30 reaches its first position before the piston 54 completes its stroke to the left. In consequence, once the diaphragm 30 has reached its first position, the pressure of the working liquid in the compression chamber 34 drops compared with that of the working liquid in the reservoir 58, which causes the valve 76 to open and causes the compression chamber 34 to be resupplied with working liquid so as to compensate for the leakage.

Some simple and effective means allowing the reservoir 58 to be filled completely with working liquid will be described hereinbelow with reference in particular to FIGS. 3 and 5.

These filling means comprise a filling neck 80, connected to the reservoir 58, and which can be stoppered with a plug 82.

Figure 5:
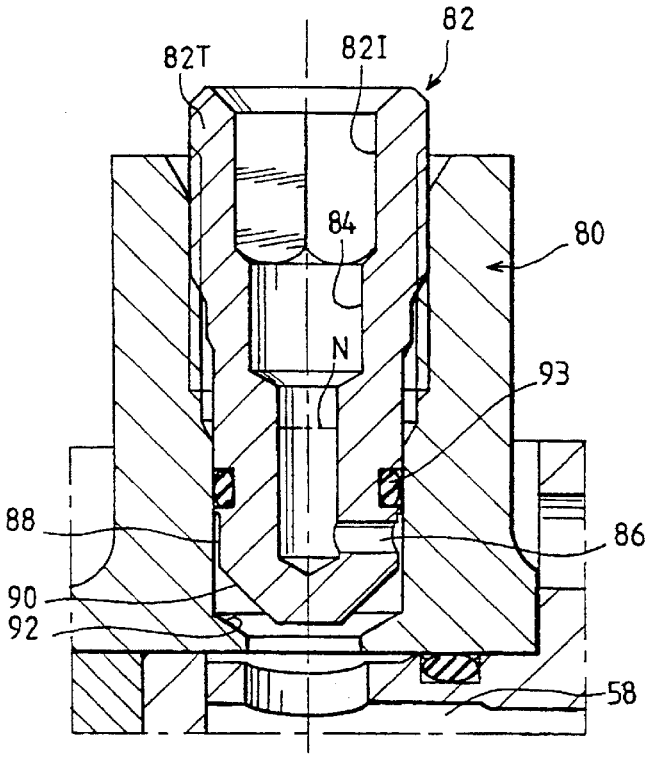
FIG. 5 is a detail view of the ringed portion 5 of FIG. 3, showing a plug that stoppers means of filling a reservoir of the pump in a prestoppering position.

In the example illustrated in FIGS. 3 and 5, the plug 82 is intended to collaborate with the neck 80 by screwing. The plug 82 has a more or less axial blind hole 84 communicating via a more or less radial bore 86 in the plug with a peripheral counterbore 88 of the plug extended axially by a stoppering surface 90 of this plug, which surface is intended to collaborate with a stoppering seat 92 formed in the end of the neck 80 near the reservoir 58.

As a preference, the stoppering surface 90 and the stoppering seat 92 have conical overall shapes, the stoppering surface 90 converging toward the stoppering seat 92.

The plug 82 can move in the neck 80, by screwing, between a position for prestoppering the reservoir 58, in which position the stoppering surface 90 is away from the seat 92, above this seat 92, as depicted in FIG. 5, and a position for stoppering this reservoir 58, in which position the stoppering surface 90 is in sealed contact with the seat 92, as is depicted in FIG. 3.

The neck 80 is capable of containing an overflow of excess working liquid of the reservoir, the level N of this overflow extending into the neck 80 above the seat 92.

It will be noted that, when the plug 82 is in its prestoppering position, the peripheral counterbore 88 of this plug communicates with the reservoir 58, so that the blind hole 84 forms a receptacle for the excess working liquid. Furthermore, when the excess is in the neck 80, the plug 82 can be moved in this neck between its prestoppering and stoppering positions.

To move the plug 82, the latter is fitted with an operating head 82T, through which the open end of the blind hole 84 emerges. The head 82T is delimited by a polygonal interior surface 82I allowing the plug 82 to be turned using a conventional tool.

Figure 6:
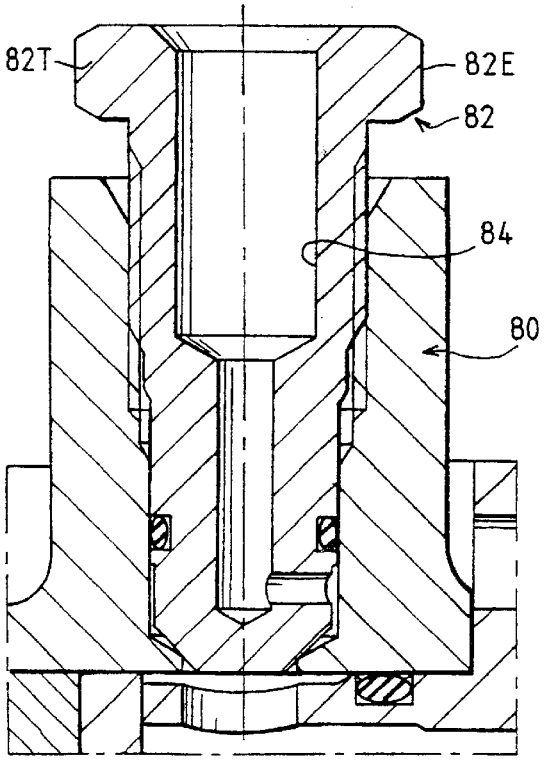
FIG. 6 is a view similar to FIG. 5, depicting a first variant of the plug.

As a variant, the operating head 82T may be delimited by a polygonal exterior surface 82E as depicted in FIG. 6, so that the plug 82 can be turned using a conventional tool.

The plug 82 carries a peripheral O-ring seal 93 positioned axially between the head 82T and the counterbore 88. This seal 93 provides sealing between the neck 80 and the plug 82 above the counterbore 88.

The plug 82 allows the reservoir 58 to be filled under vacuum as follows.

Initially, the plug 82 is screwed into the neck 80 into its prestoppering position as depicted in FIG. 5.

In order to fill the reservoir 58 with working liquid, a vacuum is pulled in this reservoir, using conventional means, then the working liquid is introduced via the blind hole 84 of the plug. Thus, the working liquid flows into the reservoir 58 by flowing into the blind hole 84, the radial bore 86 and the counterbore 88.

The reservoir 58 continues to be filled until excess remains in the neck 80 and the blind hole 84, as depicted in FIG. 5.

Finally, with the excess present, the plug 82 is screwed into its stoppering position as depicted in FIG. 3. The reservoir 58 is thus isolated from the filling neck 80, the amount of working liquid remaining in the blind hole 84 being easily removed via the end of the blind hole 84 that opens through the operating head 82T.

With reference to FIG. 3, it will be noted that the reservoir 58 is connected to conventional means 94 for compensating for the expansion of the working liquid contained in the reservoir 58. These means comprise a flexible diaphragm 96 separating a duct 98 that places the diaphragm 96 in communication with the working liquid of the reservoir 58 and a space 100 for disengaging the diaphragm 96, which space is protected by a shell 102 of hemispherical overall shape. The diaphragm 96 deforms in accordance with the variations in the working liquid volume contained in the reservoir 58.

Figure 7:
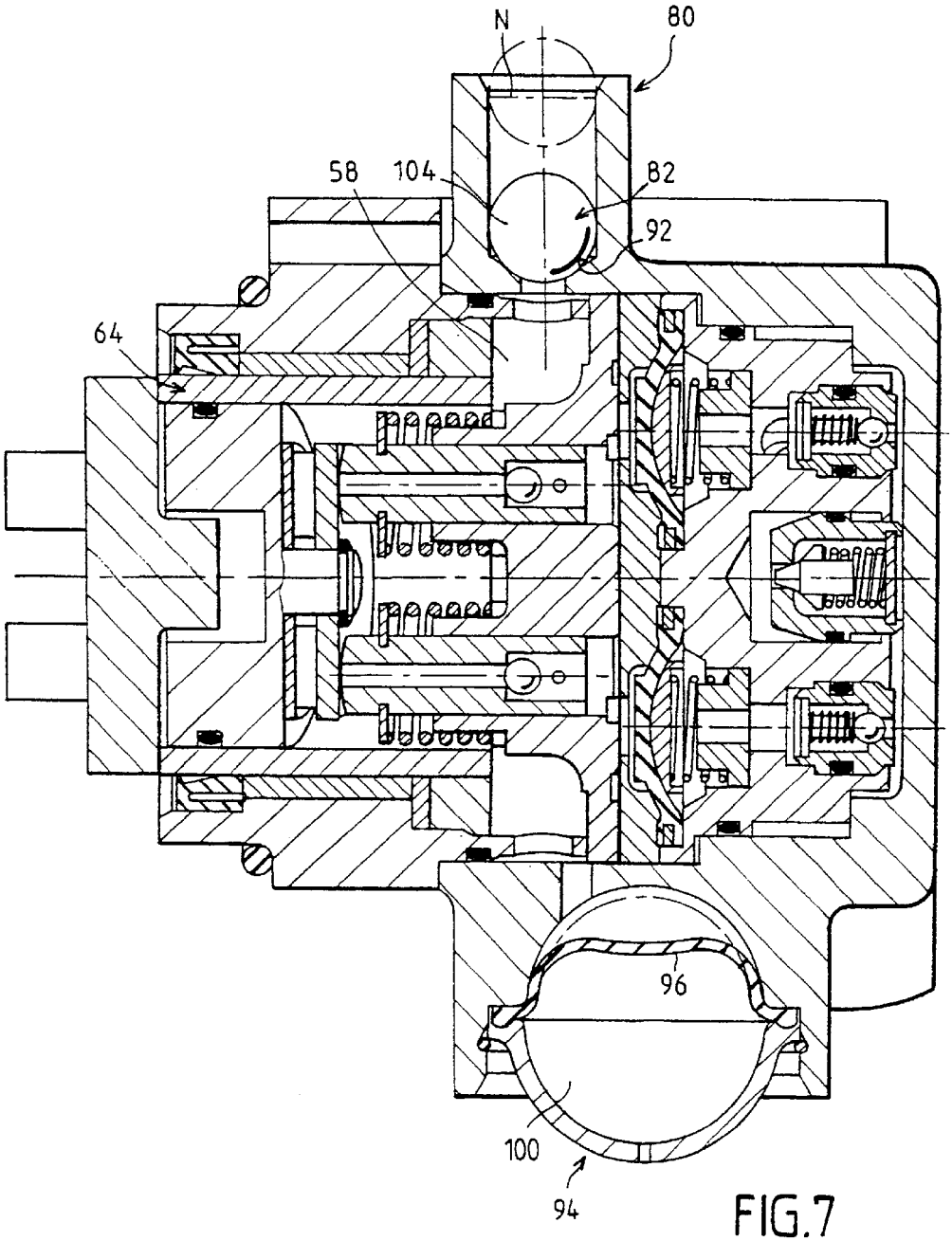
FIG. 7 is a view similar to FIG. 3, depicting a second variant of the plug.

FIG. 7 depicts a variant form of the plug 82.

In this case, the plug 82 comprises a ball 104 which can be forced to move between a position of prestoppering the reservoir 58, as depicted in chain line in FIG. 7, and a position of stoppering this reservoir 58, as depicted in solid line in this FIG. 7.

The surface of the ball 104 forms the stoppering surface intended to collaborate in sealed fashion with the seat 92 of the neck.

The filling neck 80 is stoppered using the ball 104, as follows.

In the presence of excess working liquid, the level N of which is depicted in chain line in FIG. 7, the ball 104 is placed in its prestoppering position as depicted in chain line in this FIG. 7. The ball 104 is then forced along the neck 80 so as to press it against the seat 92, as depicted in solid line in FIG. 7.

It will be noted that, during the forced movement of the ball 104 between its positions for prestoppering and stoppering the reservoir 58, the excess working liquid, forced into the reservoir 58 under the effect of the movement of the ball 104, is compensated for by the deformation of the diaphragm 96 of the expansion compensating means 94, as depicted in FIG. 7.

The hub 64 will be described in further detail hereinbelow with reference to FIG. 3.

In the example illustrated in this FIG. 3, the hub 64 comprises a sleeve 106, of axis coincident with the axis X, in which the swashplate 62 is housed.

The hub 64 also comprises a ring 108 fixed to the exterior surface of the sleeve 106.

The exterior surface of the sleeve 106 forms a peripheral cylindrical surface SG for guiding the rotation of the hub in the housing body 22. One face of the ring 108 forms a shoulder FE for the axial positioning of the hub 64 with respect to the housing body 22.

Elsewhere, the housing body 22 has a liner 110, the interior surface of which forms a cylindrical bearing surface SP in sliding contact with the peripheral guiding surface SG of the hub.

The housing body 22 also comprises a washer 112, arranged at one end of the liner 110, with one face forming a flat bearing surface FP in sliding contact with the shoulder FE of the hub.

The liner 110 and the washer 112 are fixed in a way known per se to the housing body 22 and are made of conventional materials, preferably ones with low coefficients of friction.

It will be noted that the shoulder FE of the hub 64, extending the guiding surface SG of this hub, is urged against the bearing surface FP of the housing body 22 by the elastic return force of the pistons 54 in contact with the thrust needle bearing 60 and by the pressure of the working liquid in contact with the swashplate 62.

Figure 8:
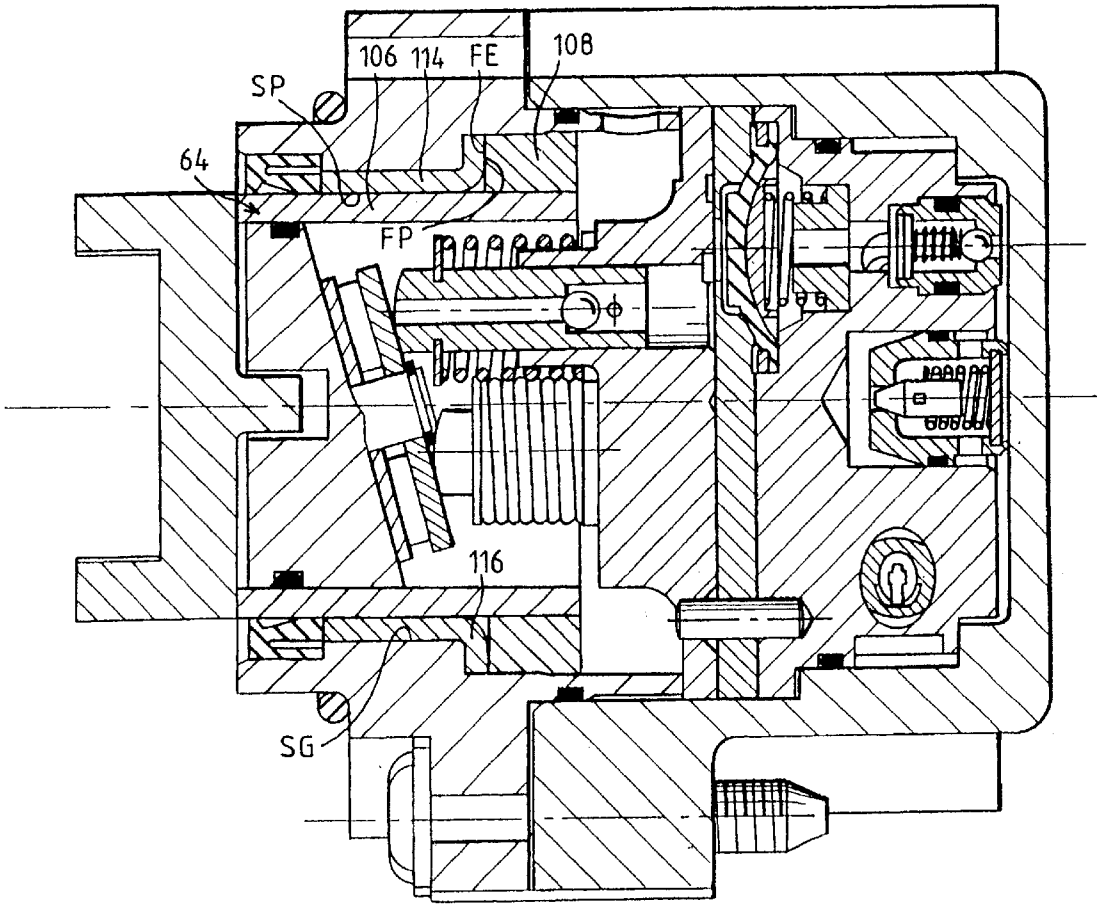
FIGS. 8 to 11 are views similar to FIG. 2, depicting four respective variants of a hub of the pump according to the invention.

According to a first variant depicted in FIG. 8, the cylindrical bearing surface SP is formed by the interior surface of a sleeve 114, borne by the housing body 22, equipped with one end extended by a flange 116 delimiting the flat bearing surface FP.

Figure 9:
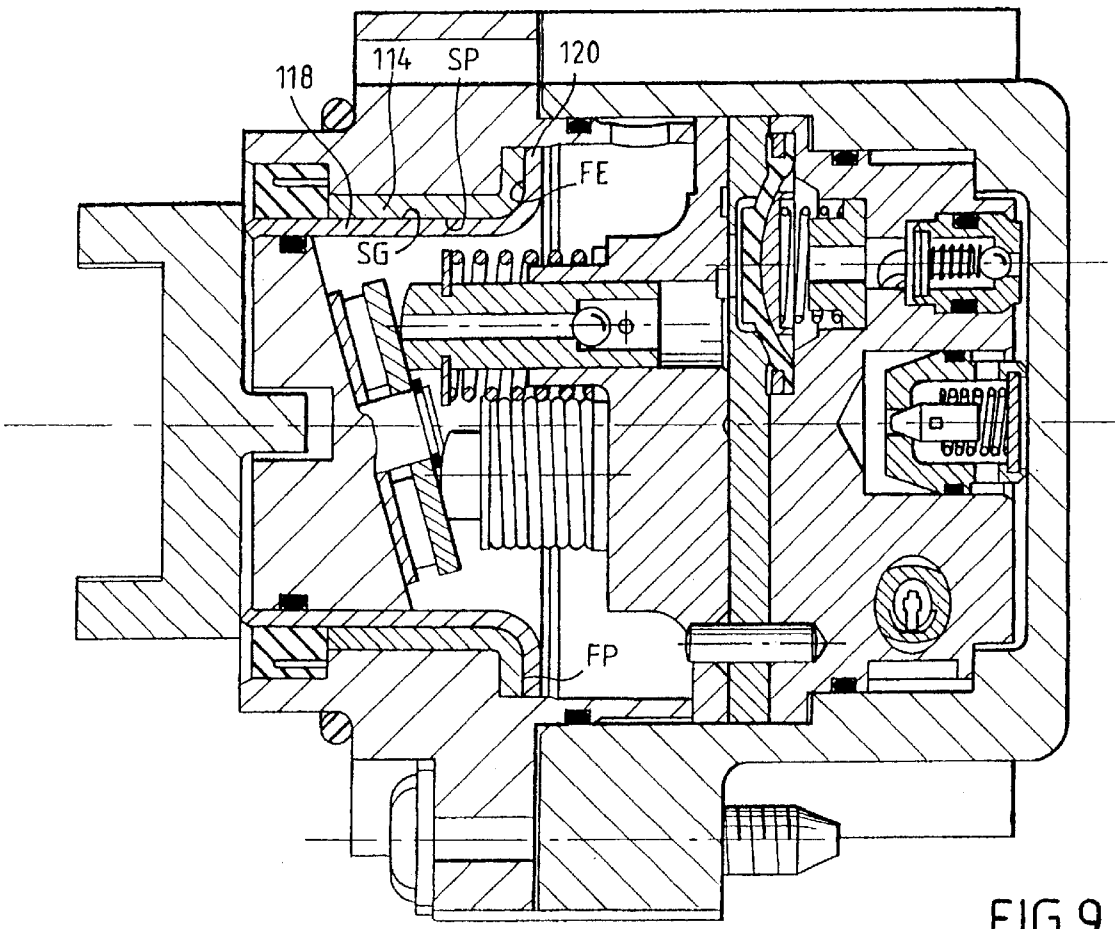

According to a second variant depicted in FIG. 9, the peripheral guiding surface SG of the hub is formed by the exterior surface of a sleeve 118, in which the swashplate 62 is housed, equipped with an end extended by a flange 120 delimiting the shoulder FE for the axial positioning of the hub. The sleeve 118 of the hub collaborates with a sleeve 114 secured to the housing body 22 of the type depicted in FIG. 8.

Figure 10:
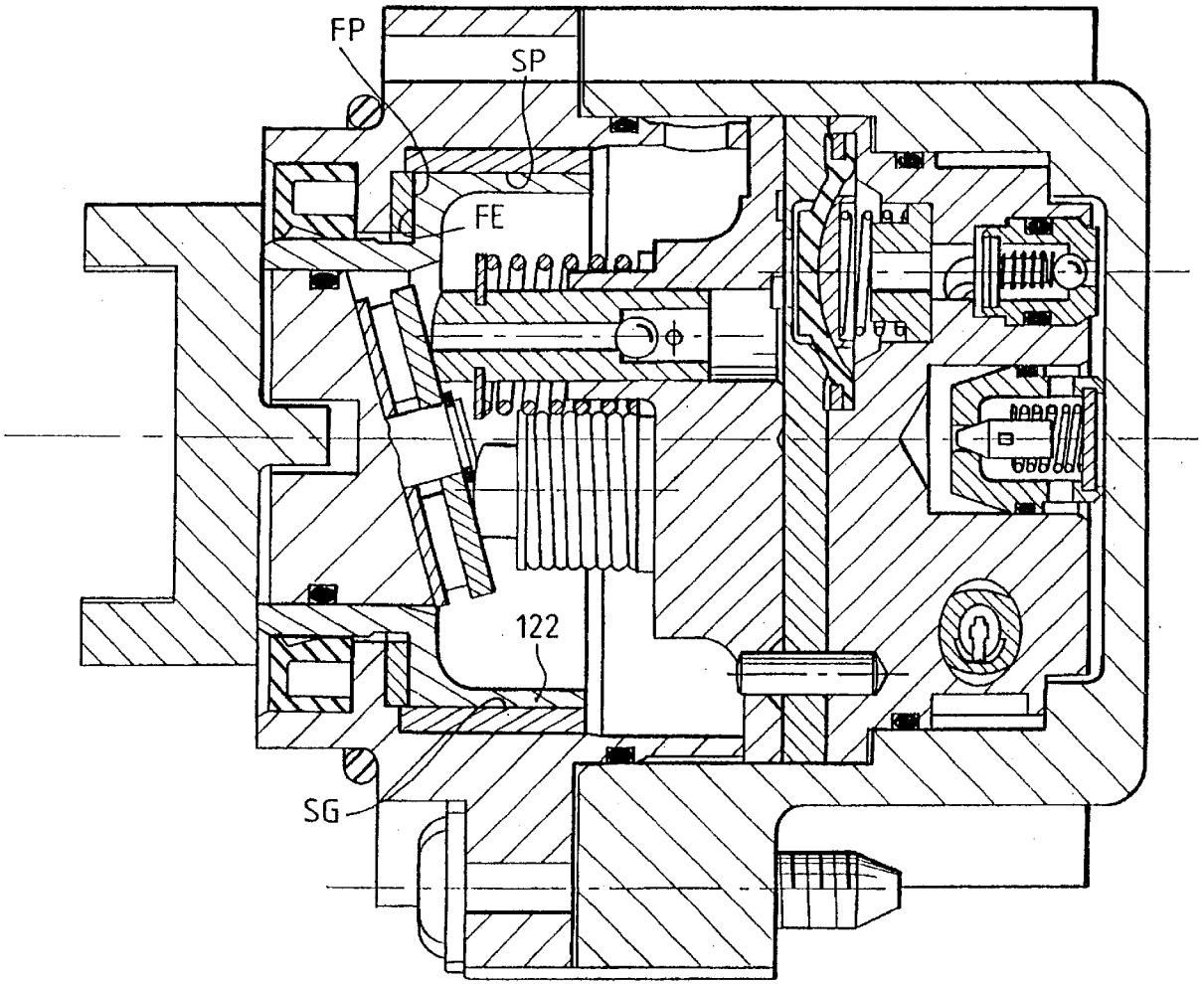
Figure 11:
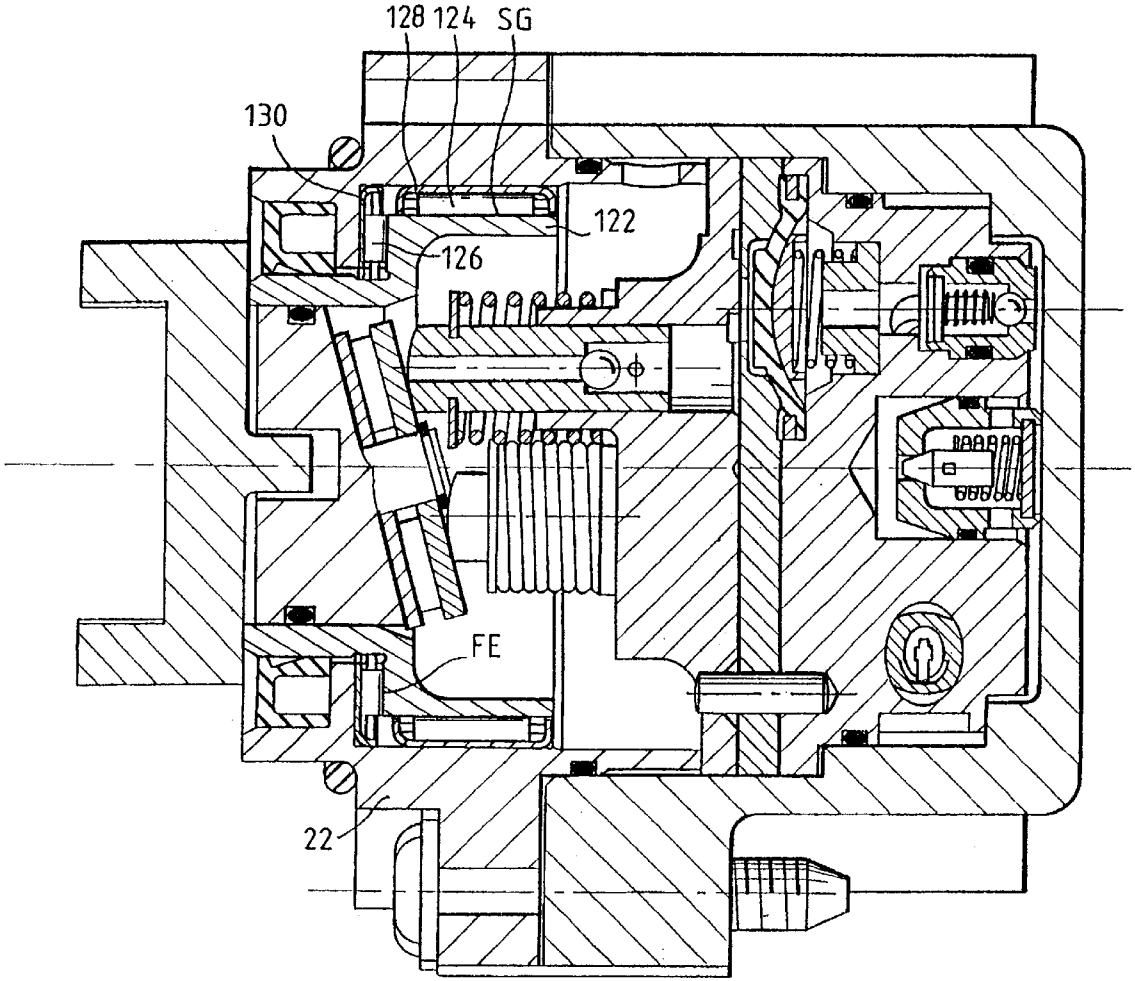

According to third and fourth variants depicted in FIGS. 10 and 11 respectively, the peripheral guide surface SG and the shoulder FE for the axial positioning of the hub are formed by the exterior surface of a stepped tubular member 122, made of a single piece, in which the swashplate 62 is housed. The stepped member 122 may easily be manufactured in conventional ways, particularly by drawing, treating and grinding.

In the third variant depicted in FIG. 10, the stepped member 122 is in sliding contact with a cylindrical bearing surface SP and a flat bearing surface FP which are formed on elements similar to those depicted in FIG. 3.

In the fourth variant depicted in FIG. 11, the peripheral guiding surface SG of the stepped member 122 is in contact with bearing needles 124 running more or less parallel to the axis X, and the axial positioning shoulder FE is in contact with bearing needles 126 running more or less radially with respect to the axis X .

The needles 124, 126 are contained by cages 128, 130 fixed, in ways known per se, to the housing body 22.

The following will be noted amongst the advantages of the invention.

The invention makes it possible to separate the intake and delivery chambers associated with the intake and delivery valves of the high-pressure pump using simple and effective means.

The housing and the valve body, made of aluminum or equivalent lightweight metal, allow the pump to be lightened, without this in any way leading to problems of differential expansion between these aluminum components and other components of the pump that are made of steel or of cast iron.

What is claimed is:

1. A high pressure pump for pumping a motor vehicle fuel, and comprising:

a main unit for pumping the fuel, which unit is actuated by a secondary unit for pumping a working liquid;

a generally cylindrical housing for receiving the main and the secondary units;

the main unit having at least an intake valve and a delivery valve for the fuel;

the valves being supported by a valve body located in the housing;

each of the valves communicating with an intake chamber and a delivery chamber for the fuel;

the intake and delivery chambers being bounded by spaced opposing coaxial surfaces of generally cylindrical shape and having a common axis substantially coinciding with an axis of the housing;

wherein the opposing surfaces include two complementary shoulders bearing on one another to form a sealed joining plane separating the intake and the delivery chambers.

2. The pump set forth in claim 1 wherein a first of the opposing surfaces forms an internal surface of a housing cover, and a second of the opposing surfaces forms a peripheral surface of the valve body;

a body of the housing being connected to the cover by at least one screw oriented generally parallel to the axis of the housing, a screw head bearing on a seat formed in the housing body, and a threaded screw portion located in a tapped orifice in the cover;

an intermediate assembly clamped axially between a skirt of the housing body, inside the cover, and the valve body;

whereby the housing body, the intermediate assembly and the valve body are clamped between the screw head and the joining plane.

3. The pump set forth in claim 2 wherein the intermediate assembly comprises a body in which a piston of the secondary unit is slidably mounted for compressing the working liquid.

4. The pump set forth in claim 2 wherein the intermediate assembly is selectively made of steel or cast iron, and the screw is made of steel; and further wherein the axial dimension of the intermediate assembly is substantially equal to the length of the screw extending between the screw head and the tapped orifice of the cover.

5. The pump set forth in claim 1 wherein the housing and the valve body are made of lightweight metal.

* * * * *